US011020841B2

(12) United States Patent
Parks

(10) Patent No.: US 11,020,841 B2
(45) Date of Patent: Jun. 1, 2021

(54) DOOR LEAF HANDLER FOR INSTALLATION OF DOOR HARDWARE

(71) Applicant: Plains Specialty Equipment LLC, Nunn, CO (US)

(72) Inventor: James S. Parks, Nunn, CO (US)

(73) Assignee: Plains Specialty Equipment, LLC, Nunn, CO (US)

( * ) Notice: Subject to any disclaimer, the term of this patent is extended or adjusted under 35 U.S.C. 154(b) by 151 days.

(21) Appl. No.: 16/555,807

(22) Filed: Aug. 29, 2019

(65) Prior Publication Data

US 2020/0070318 A1 Mar. 5, 2020

Related U.S. Application Data

(60) Provisional application No. 62/724,494, filed on Aug. 29, 2018.

(51) Int. Cl.
*B25B 5/14* (2006.01)

(52) U.S. Cl.
CPC ..... *B25B 5/14* (2013.01)

(58) Field of Classification Search
CPC ..... B25B 1/00; B25B 1/20; B25B 1/2442; B25B 1/2463; B25B 11/00; B25B 11/02; B25B 5/00; B25B 5/14; B23Q 3/00; B23Q 3/06
See application file for complete search history.

(56) References Cited

U.S. PATENT DOCUMENTS 5,762,348 A * 6/1998 Echternacht ..... E04F 21/1822 280/79.7
6,231,034 B1 * 5/2001 Walker ..... B62B 3/108 269/152
2014/0084530 A1 * 3/2014 Hodges ..... A47F 7/04 269/296
2020/0070318 A1 * 3/2020 Parks ..... B25B 5/145

* cited by examiner

*Primary Examiner* — Lee D Wilson
(74) *Attorney, Agent, or Firm* — Santangelo Law Offices, P.C.

(57) ABSTRACT

The inventive technology, in at least one embodiment, may be described as a door leaf handler comprising: a stationary support; a rotatable frame established substantially above [ said ] the stationary support; and wheels configured to allow rotation of [ said ] the rotatable frame about a frame rotation axis, wherein [ said ] the rotatable frame comprises at least one hinge, and door leaf securement rails, and is openable and closeable at [ said ] the at least one hinge along a rotatable frame opening axis. An installer can install hardware on a door leaf secured in the rotatable frame when the installer is in a first position, and then, in order for that installer to be able to install door hardware on an 10 opposite side of the door from that same position, the installer can rotate the rotatable frame, with door secured in it, 180° . Locks and rotational stops, inter alia, can facilitate operation.

16 Claims, 10 Drawing Sheets

DOOR LEAF HANDLER FOR INSTALLATION OF DOOR HARDWARE

This US NonProvisional patent application claims priority to and benefit of US Provisional Application No. 62/724,494, filed Aug. 29, 2018, said provisional application incorporated herein in its entirety.

I. BACKGROUND

This invention, in embodiments, is a door leaf handler configured to assist and streamline the installation of hardware on door leaves (i.e., the part of the door other than the hardware added to it). Embodiments of the inventive technology focus on designs that enable one-stop hardware installation on a stable, re-orientable platform using minimal labor, and increasing quality and efficiency.

Using conventional practice, hardware, i.e., locks, locksets, hinges, hydraulic closers, etc., were installed piece-by-piece in place by first hinging and swinging the door. After hanging, each piece of hardware is installed on the door, involving considerable labor, from working off a ladder to working on hand and knee. Another installation method is pre-installing hardware on door leaves horizontally on saw-horses. While perhaps increasing productivity, such also increases the need for manpower to handle the door leaf multiple times. A significant problem with such approach is the placement and removal of the door leaf due to the size and weight, hence the need, at times, for a lifting device (e.g., a powered lift) or increased manpower to place and remove the door leaf, on and from the saw-horses.

II. SUMMARY OF THE INVENTION

The inventive technology, in its various embodiments, creates a safe, stable working platform (as established, e.g., by one or more door leaf securement rails 11) from any side, particularly when the handler's rotatable frame 12 is in the locked position. Hardware can be accurately machined and installed onto the door leaf with ease, instead of requiring the hardware installer to hold heavy objects overhead or install while on hand and knee at floor level.

Another aspect of the inventive technology involves the creation of a platform where hinge and lockset hardware can be installed on the door leaf while the installer is in substantially one location, and/or when the door leaf is in two orientations of the door (each a rotation about an axis from another), with the result that required manpower and/or effort is reduced (relative to known approaches), increasing productivity and output.

The inventive equipment may assist a person in installing hardware on a door leaf in the horizontal position, allowing rotation of the door leaf (e.g., about a longitudinal axis that bisects the door from its top to bottom of the door leaf (where top and bottom refer to what would be the top and bottom of the door when it is installed)), so as to securely position the door in a first horizontal orientation, and then, upon a facile, one-man rotation of a rotatable frame 12 in which the door is secured, in a second horizontal orientation, alternatingly exposing each long edge of the door leaf towards the same working side. Embodiments of the inventive technology disclosed herein reduce the manpower required to complete the door hardwaring (i.e., hardware installation) process.

The handler apparatus 1 (specifically, its rotatable frame) can, in certain embodiments be opened from either side (i.e., from either the side of the frame where the top of the door leaf is positioned, or the side of the frame where the bottom of the door leaf is positioned) and locked in place. At this point, a door leaf can be placed on the (possibly) padded rails by hand, lifter and/or crane and the rotatable frame can be closed. Hardware can then be installed, and if necessary, the rotatable frame can then be unlocked, rotated (and then locked again) depending on whether such rotation would facilitate the installation of additional hardware. Note that it may be that in certain applications, one may desire to immediately reorient the secured door before installing any hardware, immediately after closure of the frame on the door. This is particularly the case where the door is placed vertically into the open rotatable frame.

Embodiments of the inventive technology allow for the substantial reduction of the amount of time required to hardware a door leaf, through, e.g., efficient repetition and the use of the equipment—the door leaf handler 1—provided by embodiments of the inventive technology. What may also provide labor savings is the provision of a door leaf handler 1 that allows for a lift that can be used (e.g., whether robotically or controlled by an operator) to move the door leaf on which hardware is to be installed (installed while secured by the door leaf handler of the inventive technology) from a storage configuration to a secured, hardware installation position (while secured by the door leaf handler of the invention) without requiring reorientation during the lift of the door 2 from its storage configuration. This may be seen where the door is secured in flat position and placed into the open door leaf handler 1 in a flat position (or, e.g., secured in vertical position, whether with a long door leaf edge down or a short edge and placed into the rotatable frame of the rotatable door leave hander in such vertical position).

An additional advantage of the inventive technology may be to assist general contractors by suppling pre-hardwared door leafs to their projects and jobsites, thus relieving the contractor of having to store and inventory large amounts of materials.

The advantages that particular embodiments of the inventive technology may provide is making the installation process safer, less labor intensive, providing a comfortable working platform for doing repetitive tasks and increasing productivity and efficiency.

III. BRIEF DESCRIPTION OF DRAWINGS

FIG. 1 shows a 3D labeled exploded drawing of an embodiment of the inventive door leaf handler in open configuration, awaiting placement therein of a door leaf on which hardware is to be installed. FIG. 1 shows, inter alia, rotation stops appear on the non-hinged side of each of the half circle arcs of the rotatable frame of the door leaf handler. They are shown as overhangs of the diameter chord of each of the half circle arcs.

FIG. 2 shows a pin and welded double acting hinge (one of several types of hinge designs that may operate as part of the inventive handler), which allows the door leaf handler (e.g., a clamshell) to be opened from either side of the frame. FIGS. 2-7 show individual aspects/portions of the door leaf handler with the proper operating function of each element of the device as may appear in various embodiments of the inventive technology.

Figure 5A:
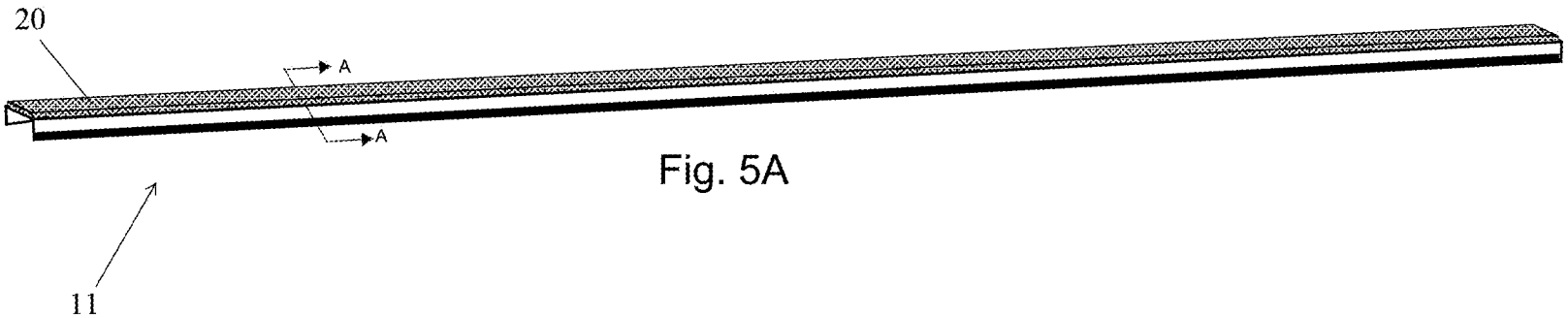
Figure 5B:
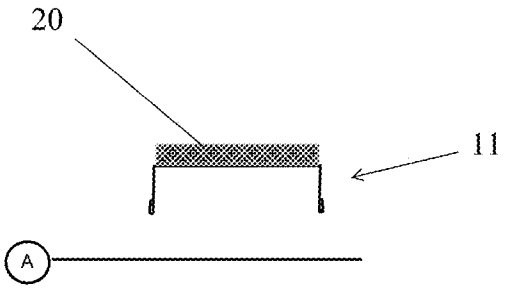

FIG. 5A and 5B (cross sectional view) show a removable, padded door leaf securement rail that, in particular embodiments of the inventive technology, may be placed on the working surfaces of the door leaf handler (e.g., of the two halves of the frame) in order to protect the door leaf while hardware is being installed. The padded rails may be replaceable, detachable (e.g., with bolts, clips, Velcro, magnets, etc.), and removable from the door leaf handler and may vary in thickness to adjust for different door thicknesses. In an alternate design (e.g., FIG. 8), it may be only pads that are attached (e.g. with bolts, clips, Velcro, magnets, etc.) and removed from the frame (whose rails are not removed to change pads).

Figure 6:
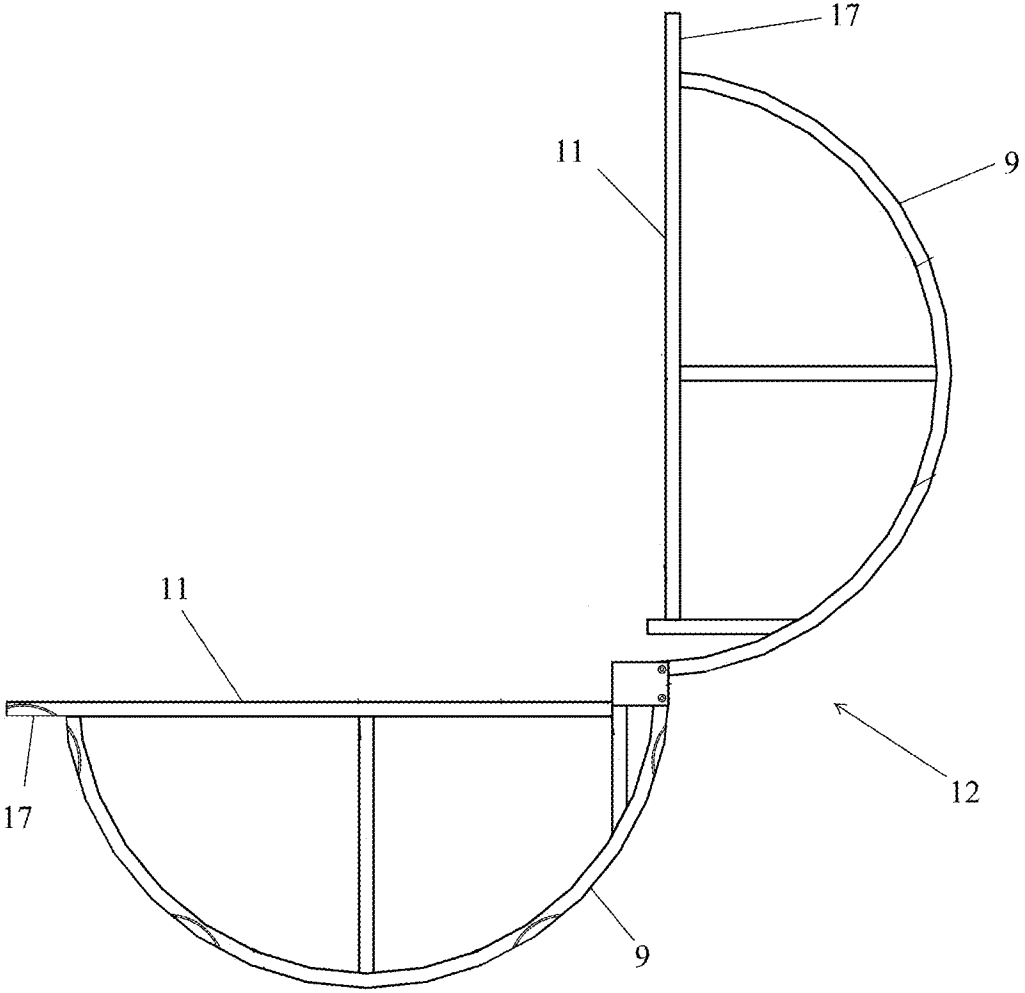

FIG. 6 shows an embodiment of a rotatable frame of a clamshell-type door leaf handler in open configuration to allow for placement of a door leaf in need of hardware installation and removal of a completed, hardwared door leaf. Upon closure, and perhaps securement in a particular working rotational position, hardware may be installed onto the door leaf. After closure, the rotational frame (here, a type of skeletal barrel assembly) can be rotated to allow access to an opposite side of the door leaf for hardware installation at an opposite of the door leaf if needed.

Figure 7:
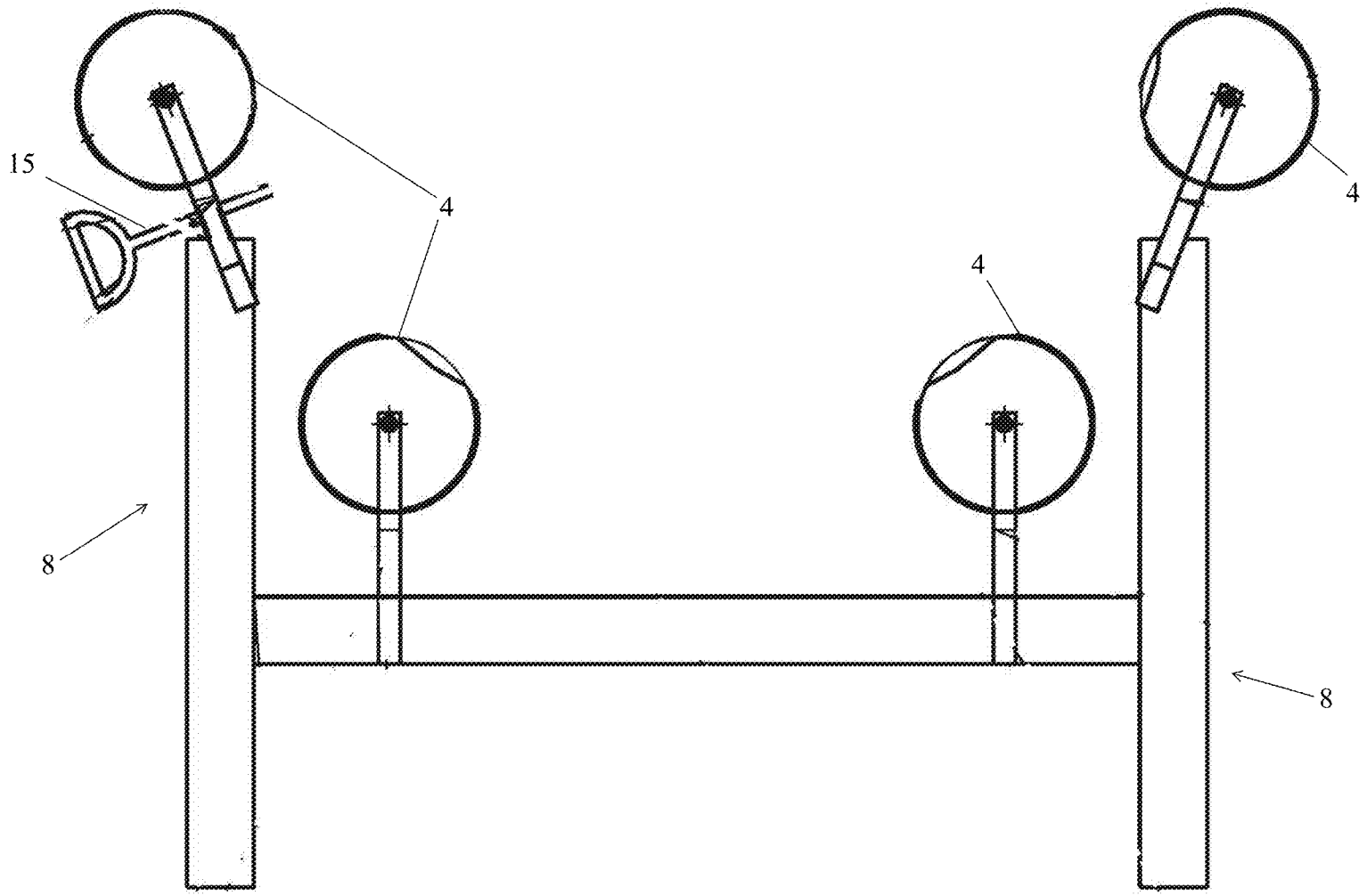

FIG. 7 shows an embodiment of a 8-wheel (a broad term that includes any type of wheel (inflatable or not) or roller, including but not limited to tire, plastic disc, etc.) stationary support for rotating clam shell (barrel) type wheel handler so as to keep the working platform stable in the horizontal locked position, and allow for rotation of the secured door leaf when desired (e.g., in order to more easily install certain door hardware). During rotation to an opposite working position, the rollers allow for the rotatable frame to remain closed and secured.

Figure 8:
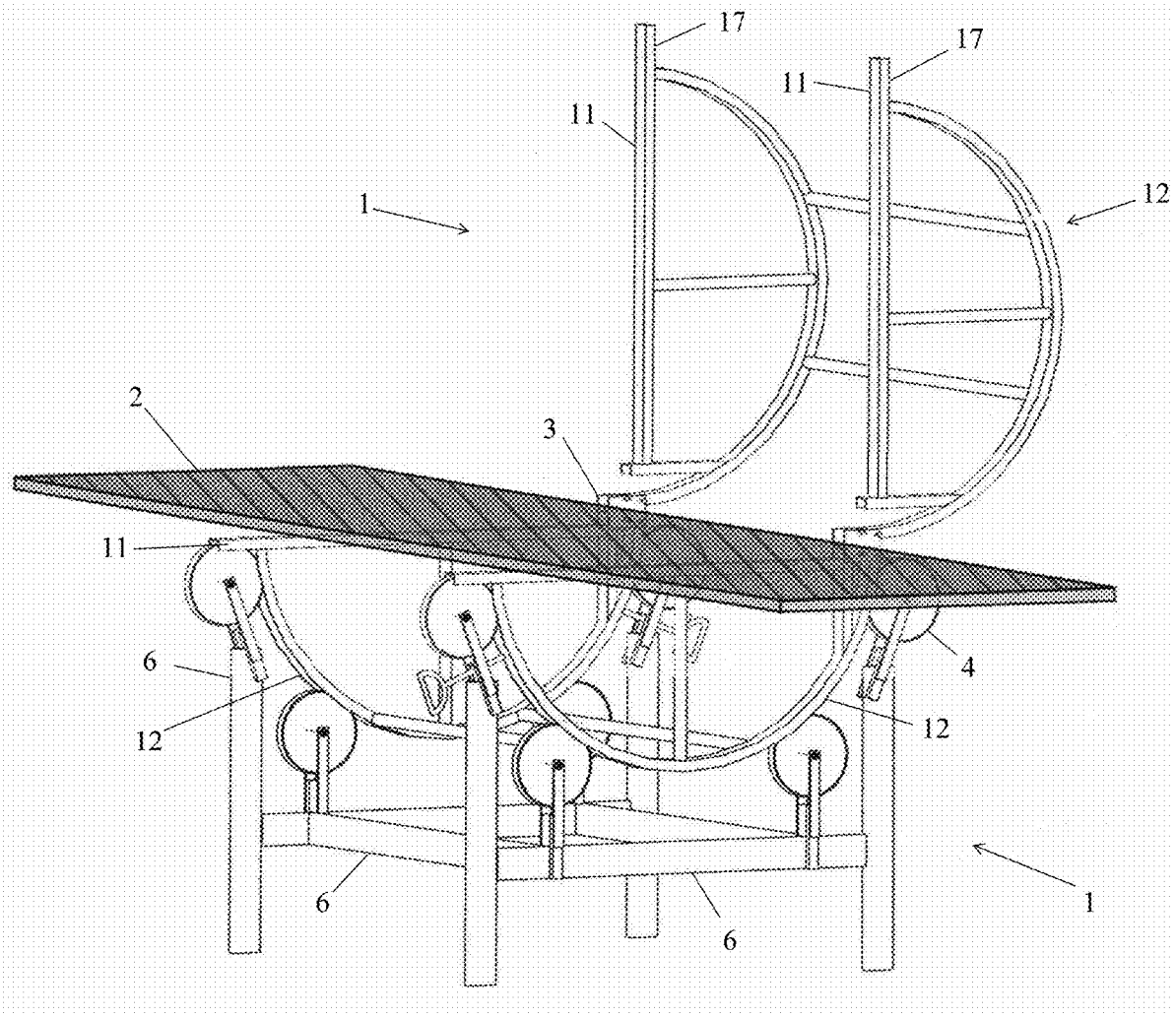

FIG. 8 shows a 3D drawing of an embodiment of the inventive door leaf handler in open configuration, awaiting placement therein of a door leaf on which hardware is to be installed.

Figure 9:
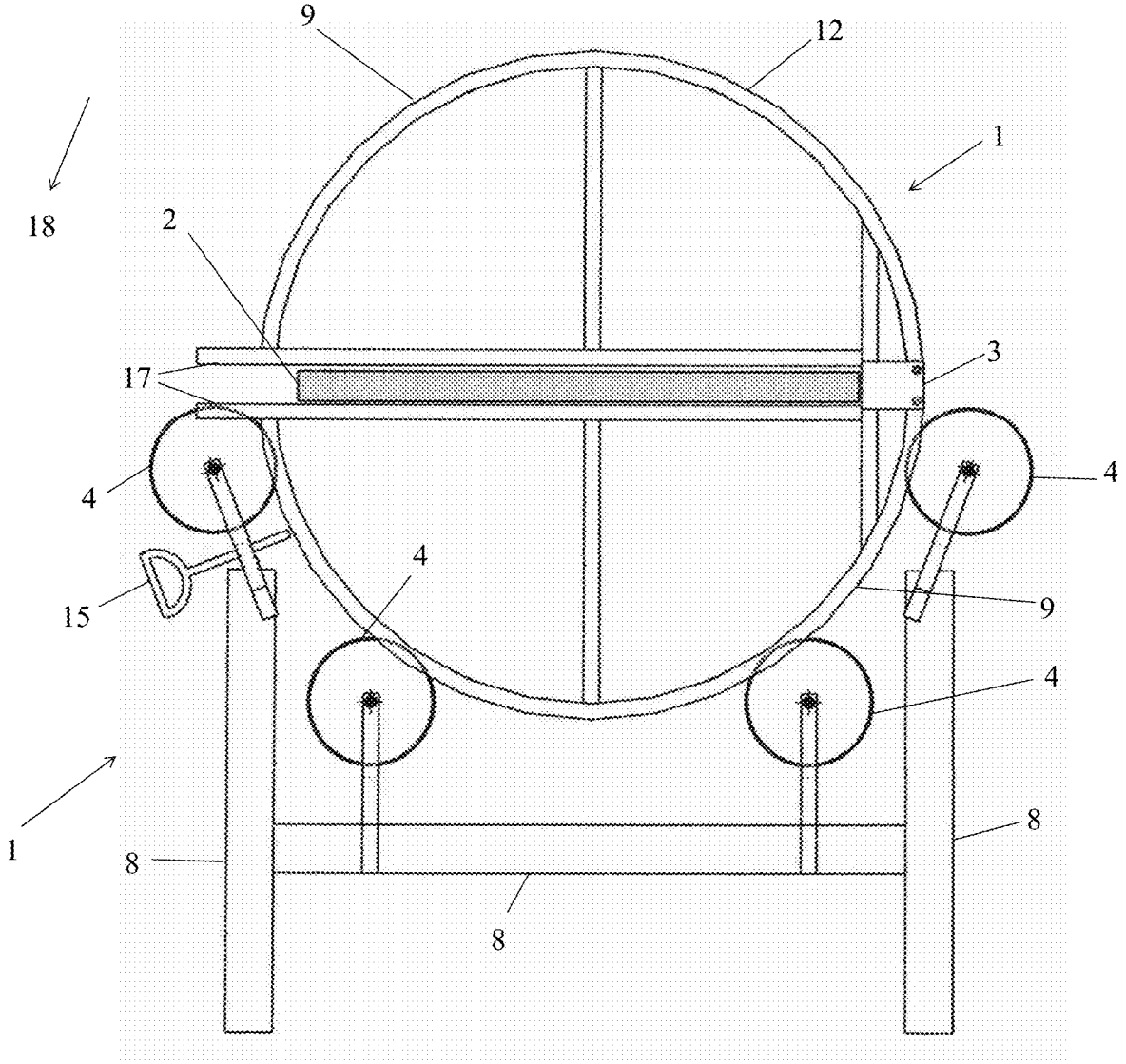

FIG. 9 shows a side view of an embodiment of the inventive door leaf handler in closed position around a door leaf on which hardware is to be installed.

Figure 10:
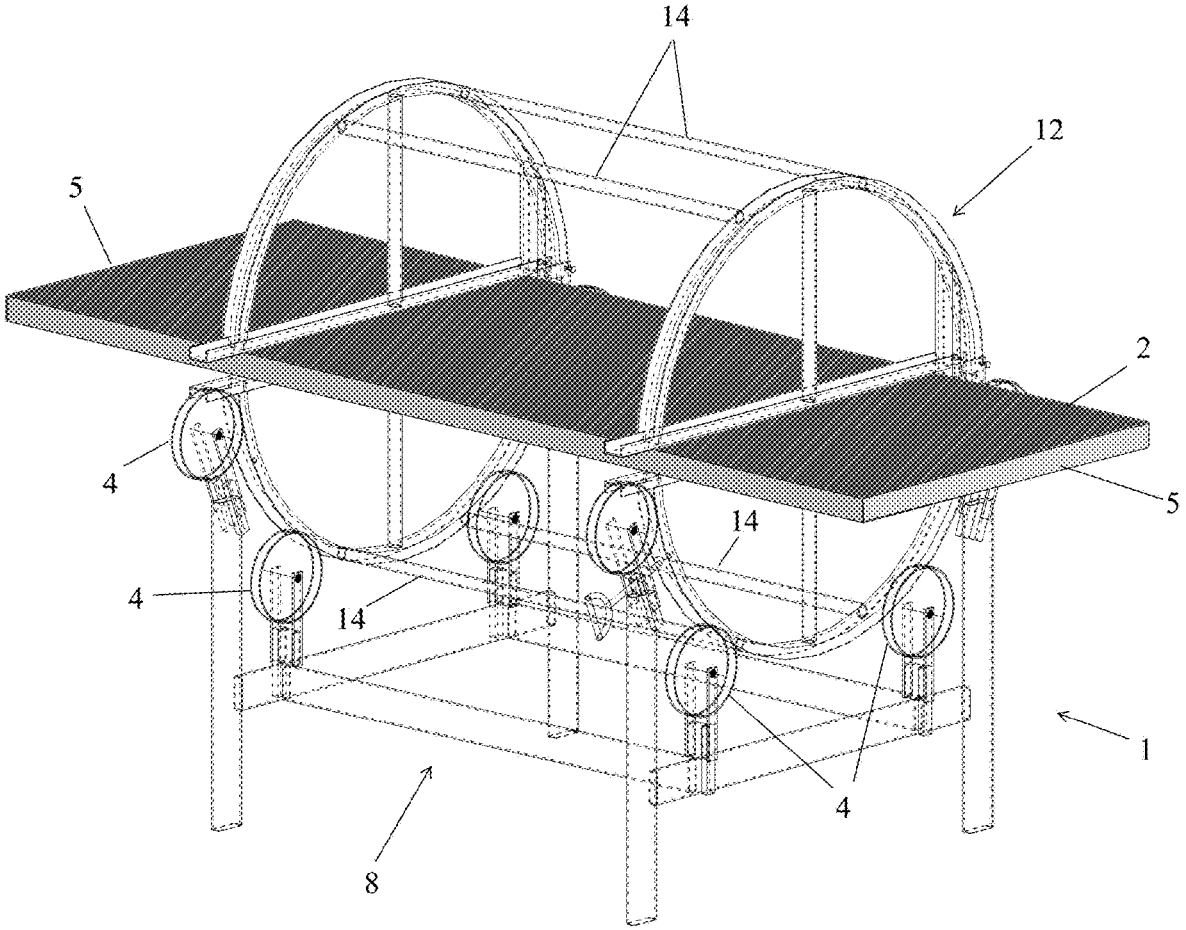

FIG. 10 shows a 3D drawing of an embodiment of the inventive door leaf handler in closed position around a door on which hardware is to be installed. Rotation of the frame is prevented by locks, which are shown in locked mode.

IV. DETAILED DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments are not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Particular embodiments of the inventive door leaf handler 1 may be described as comprising a stationary support and a rotatable frame 12 (rotatable manually and/or via possibly electrical or motorized power assisted method) that is supported by the stationary support. That rotatable frame may also: be rotatable about a frame rotation axis, comprise at least one hinge, and door leaf securement rails 11, and may be configured to be openable and closeable at the at least one hinge 3 along a rotatable frame opening axis. Wheels 4 may be configured to allow rotation of said rotatable frame about a frame rotation axis 5; accordingly, wheels may be mounted to and form part of the stationary support 6 and/or be mounted to and form part of the rotatable frame 12.

The rotatable frame 12 may be in contact with and ride on the wheels. The wheels allow the rotatable frame's facile rotation. Where the wheels are mounted to the stationary support, the support 8 (e.g. a stationary frame) and outer rims (e.g., circular arc portions 9 at opposing ends of the rotatable frame) of the rotatable frame may be shaped to cooperatively interface so that the rotatable frame does not fall off of or out of the supporting wheels. Even though wheels move (i.e., rotate), they are considered part of the stationary support where they are mounted to the stationary support, because their axes are stationary in such design. Wheels may instead be mounted to the rotatable frame, cooperatively interfacing with a circular arc (with open side facing upwards) that could be established as part of the stationary support.

Regardless of which frame the wheels 4 are secured to, at least one of the rotatable frame 12 and the wheels 4 (i.e., the rotatable frame, or the wheels, or both) may be shaped so that the rotatable frame and the wheels cooperatively interface so as to keep the rotatable frame on the wheels during rotation of the rotatable frame. Such may be achieved, in one example, where a circular arc potion 9 has a concave outer shape so that the wheels stay in the circular arc(s) during rotation of the rotatable frame. In other exemplary designs, the wheels themselves may have concave outer portions, and the portion of the circular arc portions 9 that contacts them may have a convex, potentially rounded outer shape that securely interfaces with the concave wheels. Such cooperative interface shaping to maintain smooth, secure rotation of the rotatable frame may be seen where the wheels are secured to and are part of the rotatable frame (in such design, during rotation of the rotatable frame, the wheels would rotate while also revolving around the frame rotation axis), or where the wheels are secured to and are port of the stationary support. Note that wheel is a broad term and includes but is not limited to wheels with tires (the tire is part of the wheel), rigid material rollers (e.g., plastic rollers, or polyurethane rollers, with or without bearings), etc.

The wheels may lie in two vertical planes (some, e.g., a first half, in one, and a remainder, e.g., a second half, in the other). Two portions (e.g., circular arc portions connected via the connection frame 14) of the rotatable frame may also lie in those planes, as may hinges 3. In embodiments with two locks 15, such may also lie in such planes (one in each). The rotatable frame, when closed, in certain embodiments (e.g., particularly where the two (connected) outer portions of the rotatable frame are circular 9) may have the shape of a cylinder lying on its side. It also, in preferred embodiments, is substantially (mostly) above the stationary support, although the inventive technology, as described and claimed, may indeed cover apparatus where significant portions of the stationary support are above or at substantially (within 10% of) the same height as, the rotatable frame. Such design may be seen where the stationary support is hanging from an overhead factory support such as a ceiling beam.

The rotatable frame may include two portions (e.g., circular arc portions 9) connected to each other via a connection frame 14. The two portions may be in a first and second vertical plane. That connection frame may be configured to allow working access between the two portions from each of two working sides of the door leaf handler. This may be achieved by not placing the any portion of the connection frame 14 between ends of the circular arc portions (e.g., at the ends where hinges may be, or at the opposite end where rotation stops may be) of the rotatable frame, as such could preclude access to the door leaf from a working side of the door leave when the rotatable frame is in a working rotational position.

The rotatable frame may be openable and closeable at at least one hinge 3 to expose the door leaf securement rails 11. The door leaf 5 can be placed in or removed from the rotatable frame when it is in open mode. Then, once a door leaf is placed in the rotatable frame, the rotatable frame can then be closed onto it and, if it is in (or after being moved to) a working rotational position and if a lock 15 is provided, the frame 12 can be locked in that position (if not already locked). Note that one or more lift assisting struts 16 may be provided in order to assist opening and closing (and possibly prevent slamming during closure) of the rotatable frame.

Embodiments of the inventive technology may include rotational stop(s) 17 that stop rotation of the rotational frame at a first working rotational position (e.g., see FIG. 9) from continued rotation in first rotational direction 18 (see FIG. 9) and at a second working rotational position (FIG. 9 but where hinge 3 is at left side of that figure) from continued rotation in a second, opposite rotational direction. Lock(s) 15 may be operable to lock the rotatable frame in the first and second working rotational positions. Stops may be extensions of rail beyond the circular arc portion.

In certain embodiments, door leaf securement rails 11 may include at least one removable (attachable and detachable) pad 20. That pad may be removed and replaced with a pad of a different thickness when a door leaf of a different thickness is to be placed in the apparatus in order to assure sufficient pressurized contact between the rotatable frame and the door leaf (both from above and below), so the door leaf is securely "sandwiched" between rails (see, e.g., FIG. 10) in certain designs. An independent reason for a pad may be simply prevention of marring of the rails that contact the door leaf (whether those rails be those below the door leaf alone, or those plus those above it). The pad may attach in a variety of manners (e.g., clip on, it may be shaped to securely rest on the rail, etc.) Instead of removable pads, rails themselves may instead be padded, and may be removable and replaceable with a padded rail of a different, appropriate thickness. One way such replaceable padded rails may be attached to the rest of the rotatable frame (that they may form a part of) is clips, magnets, elastic bands, etc. (as but a few examples). Note that rail is a broad term, and even includes what might conventionally be viewed as a flat surface, plate, or web of rigid material. Of course, prior to putting the door leaf into the "clam shell", it may be necessary to determine the thickness of the door leaf and select and place padded rails according to the door thickness.

It is of note that, in certain embodiments, an articulated hinge may be used instead of (or perhaps even in addition to) a replaceable pad or padded rail, in order to assure steady, uniform and sufficient pressurization of the rails against the door leaf. An articulated hinge (a type of hinge 3) may "automatically" adjust to the width of the door leaf. Any sort of hinge 3, articulating or not, maybe be double acting in that it allows for hinged opening in two opposite rotational directions. Note that hinges may be said to be substantially in the same vertical plane as the connected portions of the rotatable frame, meaning that a vertical plane containing the center of the hinges coincides with vertical planes bisecting the connected portions (e.g. circular arc portions) of the rotatable frame.

The apparatus may include at least one lock 15 operable (e.g., manually) to lock the rotatable frame in at least two different working rotational positions. The lock(s) may be spring biased, e.g., biased towards a locked position or an unlocked position. Lock(s) may be retainable in an unlocked configuration (e.g., where the lock can be disengaged and manually rotated (e.g., by 90° about the translation axis of its pin) to prevent locking engagement), although this is not a required feature. Part of the lock may be the hole(s), perhaps on the rotatable frame; a pin (possibly spring biased) of the lock may lock the rotatable frame in a certain rotational position relative to the stationary support when that pin enters such hole. Holes may be intentionally positioned so as to enable locking of the rotatable frame in working rotational positions so as to place the door leaf in working door leaf horizontal orientations, each allowing installation of hardware from different sides of the door leaf.

In certain embodiments, if a lock is biased towards the locked position, then in order to unlock, a hardware installer may pull the lock handle out of its locked position, then rotate the frame such that the end of the lock pin (that terminates in a hole in locked mode) slides against the outer circumference (e.g. circular arc portions) of the rotatable frame during rotation of that frame and "automatically" (due to the bias force) falls into a different lock hole in a different part of the rotatable frame. This is not, however, a required feature of the inventive technology, as indeed, any of a variety of locks, biased or not, could be used. Indeed, where the lock(s) is biased towards the unlocked position, then locking may require alignment of a lock pin with the hole, manually pushing in the lock, and perhaps turning it (e.g., 90 degrees) so that the bias (e.g., a spring) does not force the lock end out of locking position. Note that while the figures show a lock body(ies) 21 secured to the stationary support (and lock hole(s) on the rotatable frame), the lock body may instead be secured to the rotatable frame (with lock hole(s) in the stationary support).

Note that in certain embodiments, there may be provided hole(s) that lock the rotatable frame such that it can accept a vertically oriented door leaf. In embodiments with two locks, each of the two locks may operate on a different one of two portions (each portion perhaps being hinged) of the rotatable frame and may be configured for manual operation from a different working side of the door leaf handler.

In certain embodiments, hardware may be installed while the operator is standing on any one of two different working sides (after installation on a first side of the door leaf by a hardware installer on one working side, the door leaf may be rotated 180° and hardware on the second side of the door leaf may be installed by the installer at that same working side).

Note that, when it is desired to work on the next side of the door (e.g., after hinges are installed, an installer needs to install a lockset) certain embodiments of the inventive technology disclosed herein offer the installer the option of leaving the door in its orientation, and walking around to the other working side, or instead, the installer could stay in his/her position, unlock the rotatable frame (if locked), and rotate the rotatable frame (with door leave secured therein) 180° about its rotational axis (which may be parallel to the long axis of the door). The rotational stops may facilitate the rotation of the rotatable frame (and the door in it) about its axis, providing a secure, defined stop, often at a rotational position at which the lock(s) can secure it.

Note that in applications requiring installation of hardware at the top or bottom of the door (such labels referring to the top and bottom of the door as would appear when the door is installed in a door frame), it may be necessary for the installer to move from a working side (e.g., either the right or left of the door) and walk to the top or bottom of the door while secured in the door leaf handler.

Note that, while not necessary, there may also be some device (e.g., straps) that enables one half of the door leaf handler to be secured to the other half on the side opposite the hinges, thus reliably securing the door leaf securement rails against the door leaf (and the rotatable frame around the door leaf), although the weight of the upper part of the rotatable frame on the door is, in particular embodiments, sufficient to keep the door leaf from sliding during hardware installation. Hinges may serve as "backstops" that may prevent the door from sliding when an installer is installing from a working side that is opposite the hinges.

Further, as mentioned, at each hinge 2 (or elsewhere) there may be a lift assist strut 16, e.g., a hydraulic cylinder, to assist with the opening and closing of the openable rotatable frame. The lift assist struts may be a component of certain embodiments, and may be most susceptible to wearing out and needing replacing, but cylinders are readily available. Certain preferred embodiments are without parts that need repeated maintenance to maintain smooth operation.

Figure 1:
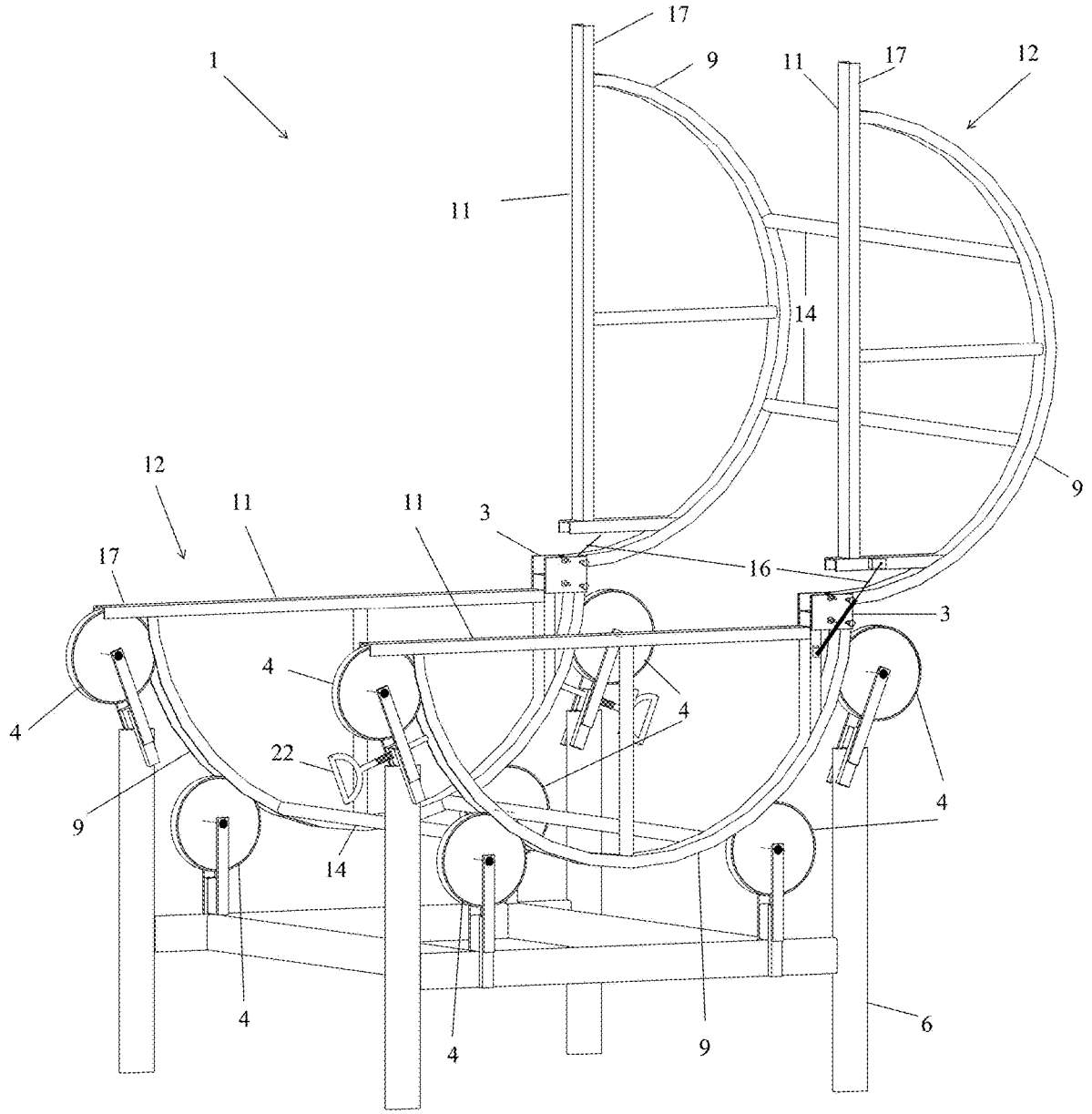
Figure 2:
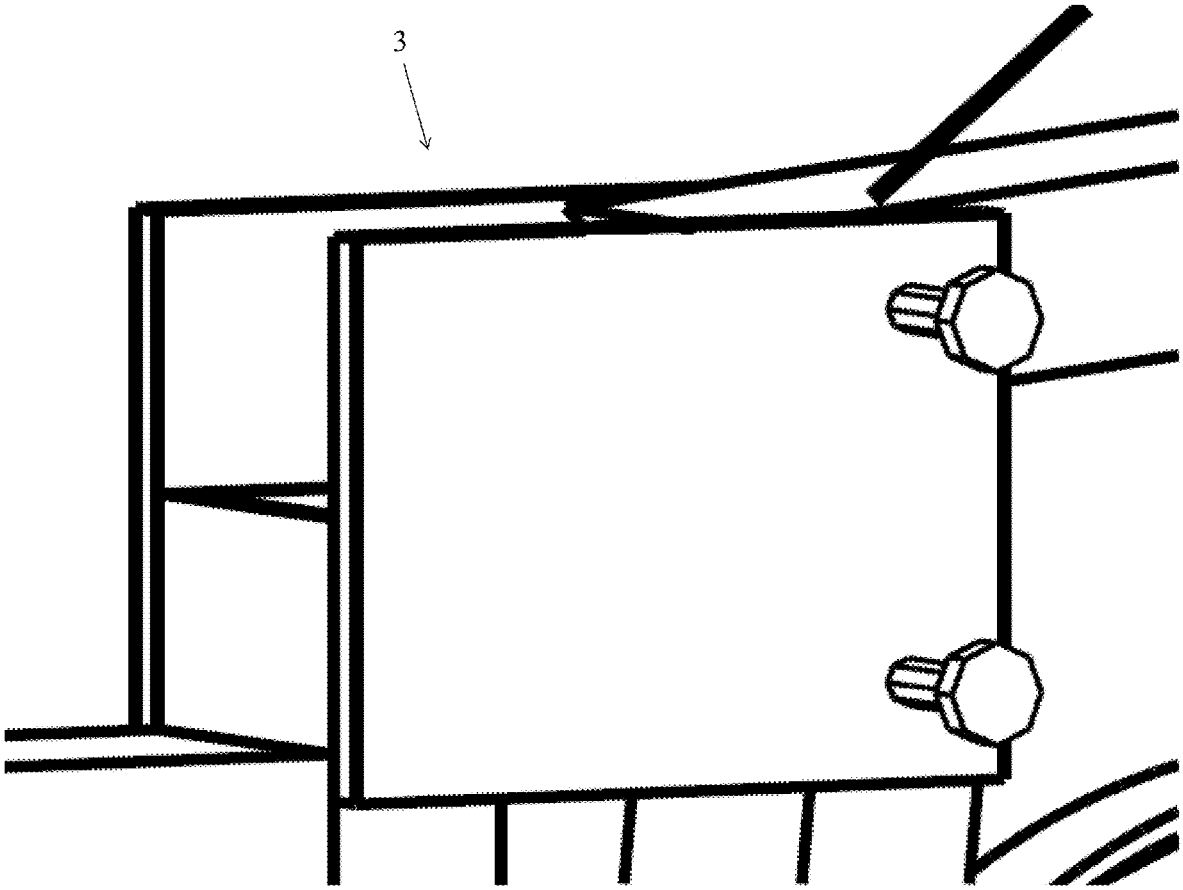
Figure 3:
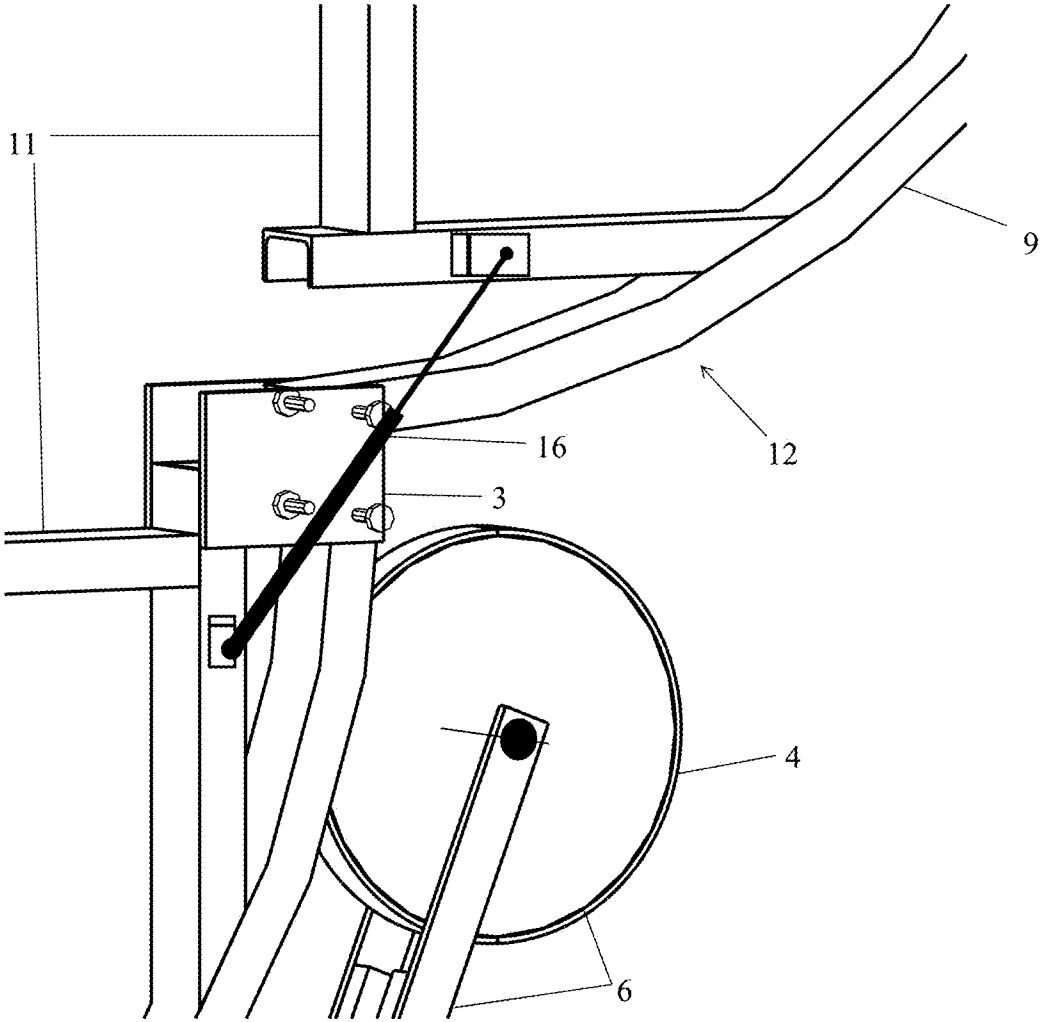
FIG. 3 shows a lift assisting strut (here, 110 lb. hydraulic cylinders) that may be added to each hinge in certain embodiments of the inventive technology to assist in opening and closing the door leaf handler.
Figure 4:
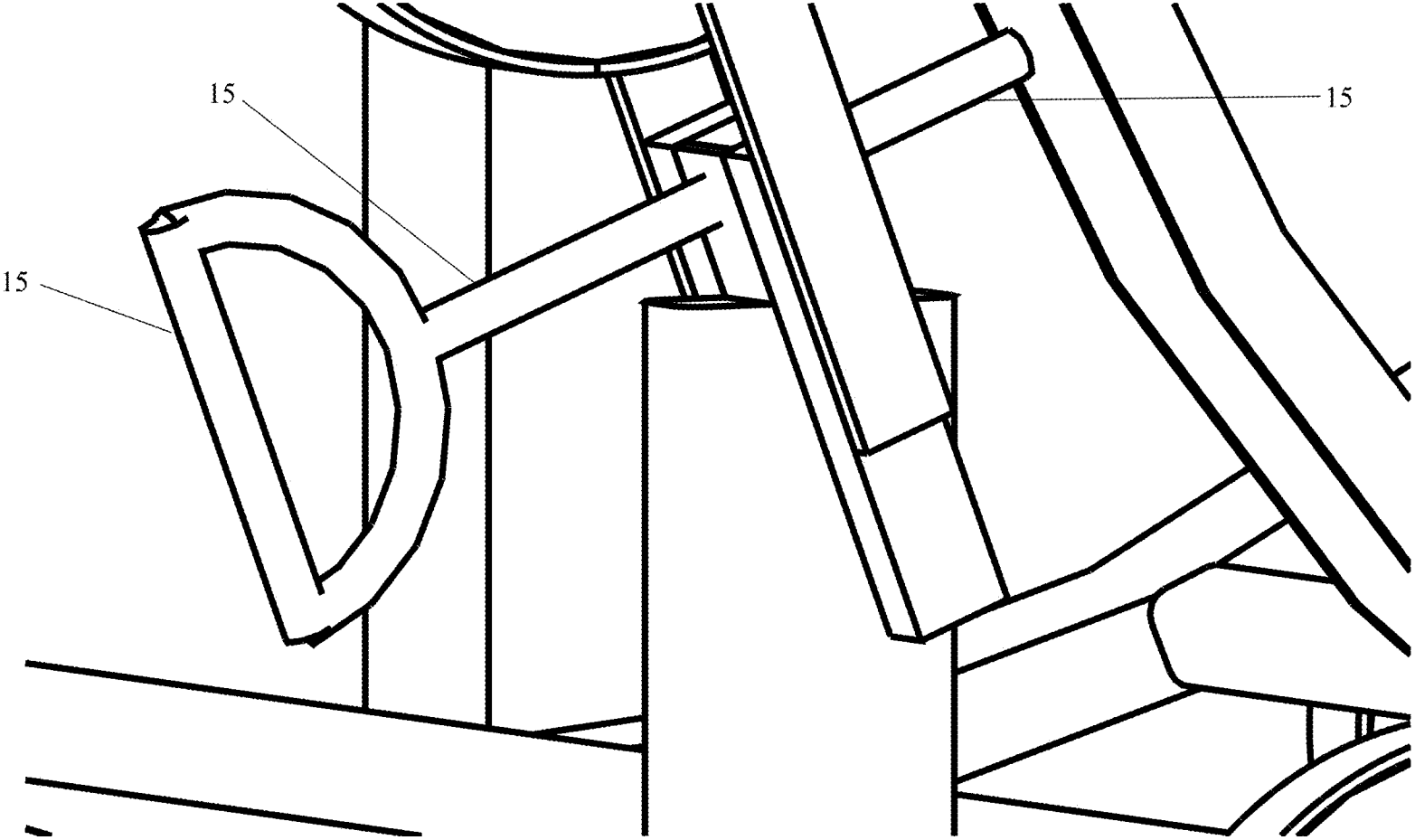
FIG. 4 shows a spring-biased lock that may be used to hold the rotatable frame of the door leaf handler in the working, desired rotational orientation and position, in particular embodiments of the inventive technology.

As mentioned in the brief description of the drawings, each of the various aspects of the inventive technology may have a specific function that, perhaps used in a particular order, allows for securement of a door leaf for hardware installation. As indicated, the door leaf handler was designed to assist in the preinstallation of door hardware. In FIG. 1 (door not shown), the 3D drawing shows a stable, horizontal, platform (establishing the lower two of the four rails 11) of a door leaf handler with a biased locking system, in the open position, awaiting placement thereon of a door leaf. It shows an open clamshell-type rotatable frame for easy loading and unloading with 110 lb. hydraulic cylinders (lift assist struts) near each hinge to assist in the opening and closing of the clamshell-type rotatable frame. Once closed on a door leaf in a certain orientation (and perhaps locked), and some hardware is installed, the lock can be released (e.g., if it is desired to flip the orientation of the door in order to facilitate installation of remaining hardware) and the rotatable frame can easily be rotated 180 degrees (stopped by any rotation stops that may exist, e.g., as shown in the figures) and locked to the next (opposite) horizontal working position. Rotational stops as shown may stop rotation when they hit a wheel that facilitates rotation, in certain embodiments.

An inventive method may relate to the use of the door leaf handler, perhaps as described above, in addition to the use of any sort of door leaf lifter (e.g., a crane-supported and -moved vacuum lifter (that uses suction to attach to the door leaf, thereafter being lifted by the crane and repositioned by the crane, and then releasing such vacuum to release the door into desired position into the open door leaf handler)). Such lifter lifts door leaves, typically individually, from a pre-hardware installation orientation (e.g., horizontal, when stored) and places them the same orientation (e.g., horizontal) into an open door leaf handler for hardware installation. That same lift (or perhaps a different one) may then remove the hardware-installed door from a certain orientation (e.g., horizontal) in the opened (after hardware installation) door leaf handler, and then place it in a post-hardware installation orientation that is perhaps the same as that orientation in which the hardware installed door was removed from the open door leaf handler. Time may be saved, and the entire process made more efficient, if there is little or no reorientation of the door during its transit from pre-installation to the door leaf handler and then also during its transit from the door leaf handler to its post hardware installation storage location. Purely translational motion of the door leaf during its pre- and post-installation transit may yield the greatest time savings. Accordingly, considerable time savings may occur if the orientation of the door (with respect to roll, pitch and yaw axes) is identical in its pre-hardware installation storage as it is in when it is placed into an awaiting open door leaf handler, and/or if the orientation of the hardware installed door when it is removed from the open door securement leaf frame is the same as its post-hardware installation door storage orientation (e.g. a stack of horizontal doors). Of course, a door whose orientation with respect to roll, pitch and yaw axes is maintained is not rotated, about any of such axes, although the entire door may be translated with respect to a location frame. It may go without saying that it may be beneficial to reduce the door leaf transit/transport distances before and after installation of hardware.

Following such method (e.g., using a lift to place the door leaf into and remove it from the door leaf handler), and use of the door leaf handler, the entire door hardware installation process (from retrieval of door leaf from pre-hardware installation storage location, to installation of hardware, to placement of hardware installed door to a desired post-hardware installation location) may generally be a one-person task, thus eliminating the need of additional staff to turn the door leaf over at any point in the entire process (further, there may be no need to re-orient the door leaf when it is being moved from its storage location, whether manually, or via lift or crane, as relatively simple and fast translational motion of the door leaf may be all that is required).

The inventive technology has a variety of applications, including but not limited to use in a large assembly process or an individual hardware installation scenario. In either, the cost savings may stem from less man-power, precision installation, faster door leaf transport to and from the hardware installation setting/location, and a less physically taxing working environment. Of all the different materials that can be used for the apparatus (indeed, any sufficiently rigid/strong material could be used), e.g., wood for a lighter weight device but one that may be easily degradable or damaged, aluminum for lighter weight and longer shelf life but susceptibility to easy bending, certain embodiments may preferably use steel for durability in design and strength to withstand years of use. Certain plastics or other non-metal materials could also be used to provide an acceptable strength. With respect to repair, certain embodiments of the inventive technology have few parts that could wear out and require replacement.

As can be easily understood from the foregoing, the basic concepts of the present invention may be embodied in a variety of ways. It involves both door leaf securement techniques as well as devices to accomplish the appropriate securement. In this application, the securement techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "securement" should be understood to encompass disclosure of the act of "securing"—whether explicitly discussed or not—and, conversely, were there effectively disclosure of the act of "securing", such a disclosure should be understood to encompass disclosure of a "securement" and even a "means for securing" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the door leaf securement devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A door leaf handler comprising:

a stationary support;

wheels mounted to and forming part of said stationary support;

a rotatable frame that:

rides on and is in contact with said wheels, is rotatable about a frame rotation axis, comprises at least one hinge, and door leaf securement rails, and is configured to be openable and closeable at said at least one hinge along a rotatable frame opening axis, wherein at least one of said rotatable frame and said wheels are shaped so that said rotatable frame and said wheels cooperatively interface so as to keep said rotatable frame on said wheels during rotation of said rotatable frame, said handler further comprising:

at least one lock operable to lock said rotatable frame in at least two different working rotational positions; and two rotational stops that stop rotation of said rotational frame at a first working rotational position from continued rotation in first rotational direction and at a second working rotational position from continued rotation in a second, opposite rotational direction.

2. The door leaf handler as described in claim 1 further comprising two locks operable to lock said rotatable frame in said first and second working rotational positions.

3. The door leaf handler as described in claim 1 wherein said door leaf securement rails comprise at least one removable pad or wherein said door leaf securement rail is a removable, padded door leaf securement rail.

4. A door leaf handler comprising:

a stationary support;

a rotatable frame established substantially above said stationary support; and wheels configured to allow rotation of said rotatable frame about a frame rotation axis, wherein said rotatable frame comprises at least one hinge, and door leaf securement rails, and is openable and closeable at said at least one hinge along a rotatable frame opening axis.

5. The door leaf handler as described in claim 4 wherein said wheels are mounted to and form part of said stationary support.

6. The door leaf handler as described in claim 5 wherein said rotatable frame is in contact with and that rides on said wheels.

7. The door leaf handler as described in claim 4 wherein said rotatable frame is a clamshell-type rotatable frame.

8. The door leaf handler as described in claim 4 wherein said rotatable frame is substantially above said stationary support.

9. The door leaf handler as described in claim 4 further comprising at least one lock operable to lock said rotatable frame in at least two different working rotational positions.

10. The door leaf handler as described in claim 4 further comprising at least one lock operable to lock said rotatable frame in at least two different working rotational positions.

11. The door leaf handler as described in claim 10 wherein said at least one lock comprises two locks.

12. The door leaf handler as described in claim 11 wherein each of said two locks operates on a different one of said two portions and is configurated for manual operation from a different working side of said door leaf securement frame.

13. The door leaf handler as described in claim 4 wherein said rotatable frame is openable and closeable at said at least one hinge to expose said door leaf securement rails.

14. The door leaf handler as described in claim 4 further comprising at least one rotational stop configured to stop rotation of said rotatable frame.

15. The door leaf handler as described in claim 4 wherein at least one of said rotatable frame and said wheels are shaped so that said rotatable frame and said wheels cooperatively interface so as to keep said rotatable frame on said wheels during rotation of said rotatable frame.

16. The door leaf handler as described in claim 4 wherein said door leaf securement rails comprises at least one removable pad.

* * * * *